US006518763B2

(12) United States Patent
Sollart

(10) Patent No.: US 6,518,763 B2
(45) Date of Patent: Feb. 11, 2003

(54) CONTROL SYSTEM FOR METERING FUEL TO AN INTERNAL COMBUSTION ENGINE

(75) Inventor: Wim Sollart, Meudt (DE)

(73) Assignee: General Motors Corporation, Detroit, MI (US)

( * ) Notice: Subject to any disclaimer, the term of this patent is extended or adjusted under 35 U.S.C. 154(b) by 5 days.

(21) Appl. No.: 09/792,387

(22) Filed: Feb. 26, 2001

(65) Prior Publication Data

US 2002/0118016 A1 Aug. 29, 2002

(51) Int. Cl.[7] ..... F02P 17/00
(52) U.S. Cl. ..... 324/378; 123/491
(58) Field of Search ..... 324/207.16, 207.24, 324/378; 123/406.12, 406.45, 406.47, 406.55, 491

(56) References Cited

U.S. PATENT DOCUMENTS 4,043,310 A 8/1977 Ichimiya et al. ..... 123/179 G
4,402,294 A * 9/1983 McHugh et al. ..... 123/480
4,636,620 A * 1/1987 Wright et al. ..... 219/501
5,474,054 A * 12/1995 Povinger et al. ..... 123/689
6,148,800 A * 11/2000 Cari et al. ..... 123/490

FOREIGN PATENT DOCUMENTS

DE 3811002 A1 10/1989
DE 3706659 C2 3/1992
DE 4039598 A1 6/1992
DE 4435419 A1 4/1996

* cited by examiner

*Primary Examiner*—Christine Oda
*Assistant Examiner*—Etienne P LeRoux
(74) *Attorney, Agent, or Firm*—Christopher DeVries

(57) ABSTRACT

A method of determining the temperature of a fuel injector in an internal combustion engine includes the steps of supplying current to the fuel injector on engine startup, measuring the supplied current and voltage to the fuel injector, calculating the resistance of the fuel injector based on the measured current and voltage, and determining the temperature of the fuel injector based on the calculated resistance.

6 Claims, 1 Drawing Sheet

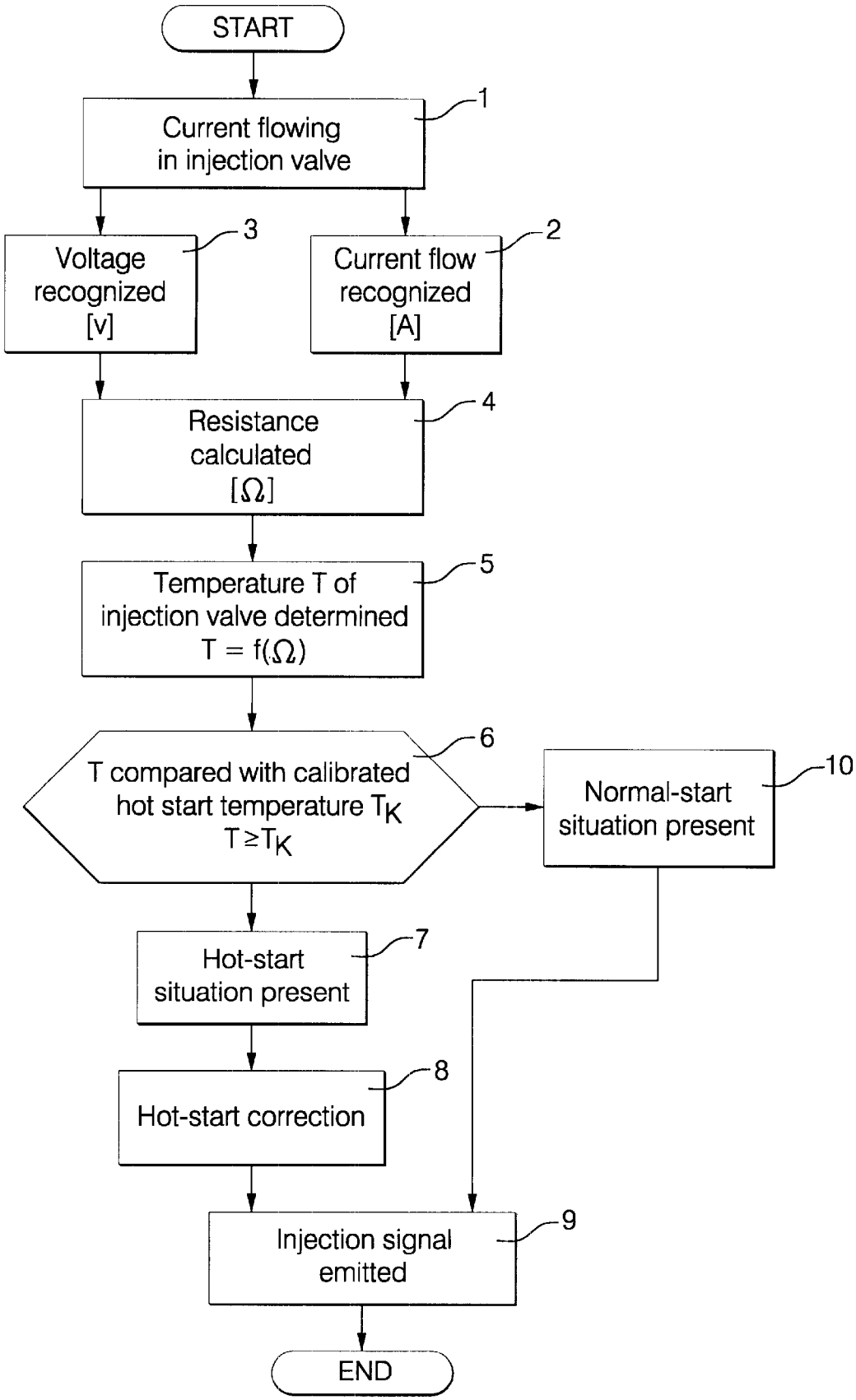
START
Current flowing in injection valve
1
Voltage recognized [v]
3
Current flow recognized [A]
2
Resistance calculated [Ω]
4
Temperature T of injection valve determined T = f(Ω)
5
T compared with calibrated hot start temperature $T_K$ $T \geq T_K$
6
Normal-start situation present
10
Hot-start situation present
7
Hot-start correction
8
Injection signal emitted
9
END

CONTROL SYSTEM FOR METERING FUEL TO AN INTERNAL COMBUSTION ENGINE

TECHNICAL FIELD

The present invention relates to a control system for metering fuel to an internal combustion engine.

BACKGROUND OF THE INVENTION

A hot start of an internal combustion engine refers to restarting the engine after prolonged operation of the engine, especially under a load, with a brief interruption of operation following it. In the case of a brief interruption of operation of a hot engine, heat will form bubbles of fuel vapor in the fuel supply system that could cause problems during the next start-up if they were to occur directly in the injection valve. These fuel vapor bubbles prevent the regular metering of fuel. It is therefore customary to have a prolonged injection signal emitted under hot-start conditions so that in the event of a fuel vapor lock, a quantity of fuel sufficient for a safe start is supplied to the combustion process. Alternatively, a signal emitted to initiate the circulation of fuel through the valve, via a return line, will flush out bubbles of fuel vapor to prevent vapor lock.

In order to take measures to avoid problems in the case of a hot start of an internal combustion engine, the control system for fuel metering must recognize when a hot-start situation is present. In previous fuel metering control system for an internal combustion engine, a hot-start situation is assumed when the temperature of the coolant of the internal combustion engine is above a pre-assigned threshold temperature and the difference between the present intake air temperature and a stored temperature exceeds a pre-assigned magnitude. The hot-start situation is considered no longer to exist if the coolant temperature of the internal combustion engine lies below a second threshold temperature or if the internal combustion engine has taken in a predetermined quantity of air.

The disadvantage of these previous fuel metering control systems is that the temperature of the coolant is used as the decisive reference magnitude for recognizing a hot-start situation. An increase in coolant temperature may occur with considerable time delay with respect to the temperature in the combustion chamber and therefore also the injection valve. Thus, it may occur in practice that an internal combustion engine, after a cold start, may immediately be driven under a full load for a short time with a brief interruption of operation. In this case, the immediate environment of the combustion chamber and the injection valve is brought to a high operating temperature while the coolant itself remains relatively cool. During the interruption of operation, fuel vapor bubbles may form in the injection valve and make a restart difficult. This is because a hot-start temperature cannot be recognized based on the temperature of the coolant.

SUMMARY OF THE INVENTION

The object of the present invention is to provide a control system or signal processing system for metering fuel to an internal combustion engine in such a way that a hot-start situation can be recognized under all operating conditions of the internal combustion engine using a simple cost-effective method.

The method of the present invention starts with the assumption that the main problem of a hot start is caused by the vapor lock inside the injection valve. The detection of the temperature at the injection valve by temperature sensors, however, would involve a considerable cost because there would have to be room to install such sensors, and a signal line would have to run from the sensor. In addition, it would be necessary to monitor the sensor in order to test the functional capability of the sensor.

The method of the present invention makes use of the fact that the resistance of an electrical conductor changes with temperature. This is also true for the electrical conductors located on the electrical opening device of the injection valve which generally have the form of a magnetic coil. If these conductors are carrying current, then the signal processing system provided for supplying fuel can determine, by known methods, the flow of current as well as the present voltage. Using Ohm's law, these values enable calculation of the actual present electrical resistance of the conductor. From the present electrical resistance and also using the above-mentioned signal processing system, the present temperature at the location of the electrical conductor can be determined directly on the injection valve. By comparison of the present temperature determined with a pre-assigned calibrated temperature value whose value is determined empirically as the limiting temperature for a hot-start situation, and which is stored in a signal processing system, the hot-start situation can be identified very precisely as a function of the temperature status at the injection valve. The hot-start situation can be identified independent of prior or subsequent states in other locations in the internal combustion engine. Special sensors and signal transmission lines and terminals for their functional control are not required.

By choosing a material for the electrical conductor whose temperature-variable resistance is known, one may influence the response behavior of the control system for recognizing a hot-start situation. The values of the present temperature on the injection valve as a function of voltage and resistance on the electrical conductor of the opening device may be stored in a memory in the signal processing system. Accordingly, the temperature values are available in real time even in the case of very small computational power of the signal processing system.

When the control system of the present invention is used on different internal combustion engines of a model series, varying operating conditions can be allowed for by using additional memory with correction factors. These correction factors can also be stored in a memory for the control system individually during the programming of the computer control system for a specific internal combustion engine, or they can be stored in a fixed memory and called up specifically for a given model series.

The method of the present invention may be executed in any known electronic engine control system or signal processing system.

BRIEF DESCRIPTION OF THE DRAWINGS

The drawing FIGURE is a flow chart of the preferred method of the present invention.

DESCRIPTION OF THE PREFERRED EMBODIMENT

An example of the preferred embodiment of the method of the present invention is shown in the FIGURE as a flow chart. During or before the starting of an internal combustion engine with the control system according to the present invention, the opening device of the injection valve is loaded with current at block 1. At that time, the current A flowing and the voltage V occurring are detected at blocks 2 and 3. From the voltage V and current A, the actual resistance Ω is determined at block 4 in which the initial values are either brought into relation with each other according to Ohm's law by a calculation operation or are compared with a table stored in memory, thus permitting the corresponding correlations to be made. According to a table which is stored in the control system or signal processing system, referencing the resistance Ω, a locally present temperature T corresponding to the actual resistance Ω on the injection valve is determined at block 5. In this case, the stored table represents the functional dependence of the temperature T on the resistance Ω (T=f[Ω]).

The present temperature T, determined using injection valve resistance Ω, is compared with a calibrated temperature $T_k$ at block 6 determined empirically and stored in the signal processing system. This temperature $T_k$ represents the hot-start limit to be considered for the present internal combustion engine. If this limit is reached or exceeded, then a hot-start situation is determined at block 7 and a hot-start correction signal at block 8 is added to the injection signal generated at block 9. A variety of other engine parameters may be adapted with the hot-start correction such as a correction for the air requirement, a raising of the idle speed or a correction of the ignition timing point. If this calibrated temperature value $T_k$ is not reached during a start, then normal-start conditions are present at block 10. As a result, an injection signal at block 9 is generated without a hot-start correction. Similarly, other hot-start related adaptations are no longer necessary.

While this invention has been described in terms of some specific embodiments, it will be appreciated that other forms can readily be adapted by one skilled in the art. Accordingly, the scope of this invention is to be considered limited only by the following claims.

What is claimed is:

1. A method of correcting a hot start for a fuel injector in an internal combustion engine comprising the steps of:

supplying current to the fuel injector on startup;

measuring the supplied current and voltage to the fiel injector;

calculating the resistance of the fuel injector based on the measured current and voltage;

determining the temperature of the fuel injector based on the calculated resistance; and generating a hot start correction factor for the fuel injector using the temperature of the fuel injector and the idle speed of the internal combustion engine.

2. The method of claim 1 further comprising the step of comparing the determined temperature of the fuel injector to a stored hot-start temperature value to determine if a hot-start condition exists for the fuel injector.

3. The method of claim 2 further comprising the step of correcting a signal to the fuel injector to compensate for the hot-start condition.

4. The method of claim 2 further comprising the step of increasing the amount of fuel supplied to the fuel injector to compensate for the hot-start condition.

5. A fuel injector temperature compensation system comprising:

a fuel injector;

a controller coupled to said fuel injector;

a current sensor for detecting the current through the fuel injector, wherein the controller calculates a resistance for said fuel injector based upon the detected current;

a table located in said controller mapping said resistance to temperature for said fuel injector; and wherein said temperature in conjunction with the idle speed of an internal combustion engine is used to generate a hot start correction for said fuel injector.

6. The fuel injector temperature compensation system of claim 5 wherein the temperature of said fuel injector is compared to a hot stat temperature threshold to determine the operation of said fuel injector.

* * * * *